US008104242B1

(12) United States Patent
Fouad et al.

(10) Patent No.: US 8,104,242 B1
(45) Date of Patent: Jan. 31, 2012

(54) CONCRETE-FILLED METAL POLE WITH SHEAR TRANSFER CONNECTORS

(75) Inventors: Fouad H. Fouad, Birmingham, AL (US); Earl R. Foust, Birmingham, AL (US)

(73) Assignee: Valmont Industries Inc., Omaha, NE (US)

( * ) Notice: Subject to any disclaimer, the term of this patent is extended or adjusted under 35 U.S.C. 154(b) by 947 days.

(21) Appl. No.: 11/425,629

(22) Filed: Jun. 21, 2006

(51) Int. Cl.
*E04C 5/08* (2006.01)

(52) U.S. Cl. ..... 52/223.4; 52/223.14; 52/834; 52/334

(58) Field of Classification Search ..... 52/736.3, 52/295, 745.17, 223–223.4, 834, 835, 848, 52/334, 831, 836, 843, 223.13, 223.14
See application file for complete search history.

(56) References Cited

U.S. PATENT DOCUMENTS

| | | | | |
|---|---|---|---|---|
| 973,670 | A | 10/1910 | Kinnear | |
| 1,821,850 | A * | 9/1931 | Riemenschneider | 138/173 |
| 3,652,756 | A * | 3/1972 | Van Buren | 264/228 |
| 3,963,056 | A | 6/1976 | Shibuya et al. | |
| 3,987,593 | A * | 10/1976 | Svensson | 52/98 |
| 4,018,055 | A | 4/1977 | LeClercq | |
| 4,127,002 | A * | 11/1978 | DeWitt | 405/239 |
| 4,166,347 | A * | 9/1979 | Pohlman et al. | 52/223.4 |
| 4,242,851 | A | 1/1981 | Pohlman et al. | |
| 4,445,321 | A * | 5/1984 | Hutchinson | 57/223 |
| 4,604,003 | A * | 8/1986 | Francoeur et al. | 405/256 |
| 4,722,156 | A * | 2/1988 | Sato | 52/98 |
| 4,783,940 | A | 11/1988 | Sato et al. | |
| 5,050,356 | A * | 9/1991 | Johnson et al. | 52/295 |
| 5,285,614 | A * | 2/1994 | Fouad | 52/848 |
| 5,542,229 | A | 8/1996 | Saito et al. | |
| 5,746,538 | A * | 5/1998 | Gunness | 404/6 |
| 5,784,851 | A * | 7/1998 | Waugh | 52/848 |
| 6,123,485 | A | 9/2000 | Mirmiran et al. | |
| 6,295,782 | B1 * | 10/2001 | Fyfe | 52/834 |
| 6,322,863 | B1 * | 11/2001 | Kubicky | 428/34.5 |
| 6,453,636 | B1 * | 9/2002 | Ritz | 52/835 |
| 6,705,058 | B1 | 3/2004 | Foust et al. | |
| 6,851,231 | B2 * | 2/2005 | Tadros et al. | 52/223.4 |
| 6,938,392 | B2 | 9/2005 | Fouad et al. | |
| 7,107,730 | B2 * | 9/2006 | Park | 52/223.8 |
| 7,343,718 | B2 * | 3/2008 | Foust et al. | 52/745.17 |
| 2004/0065033 | A1 * | 4/2004 | Bleibler | 52/309.7 |

FOREIGN PATENT DOCUMENTS

| | | |
|---|---|---|
| FR | 1260146 | 3/1960 |
| GB | 745329 | 2/1956 |

OTHER PUBLICATIONS

Definition of "stud", Oxford English Dictionary, accessed Jun. 21, 2011, http://www.oed.com/view/Entry/192046?rskey=fAZuTp&result=1&isAdvanced=false#eid.*

Definition of "diameter", Oxford English Dictionary, accessed Jun. 21, 2010, http://www.oed.com/view/Entry/51945?redirectedFrom=diameter#eid.*

* cited by examiner

*Primary Examiner* — William Gilbert
*Assistant Examiner* — James Ference
(74) *Attorney, Agent, or Firm* — Camoriano and Associates; Theresa Fritz Camoriano

(57) ABSTRACT

A metal pole is pre-stressed and filled with concrete. The metal pole includes shear transfer connectors projecting inwardly from the inner surface of the metal pole.

17 Claims, 5 Drawing Sheets

CONCRETE-FILLED METAL POLE WITH SHEAR TRANSFER CONNECTORS

BACKGROUND

The present invention relates to poles, and, more particularly, to concrete filled steel poles. Poles generally are fixed at their lower end (typically bolted or buried into the ground) and generally have weights or applied loads on their upper end (such as light fixtures or electrical conductors). These loads impose bending, shear and normal forces along the pole length. A pole is primarily designed to effectively withstand bending forces, and it should be able to withstand the flexural loads imposed on it without exceeding the prescribed deflection limits. This may be contrasted with columns, which are typically designed to withstand mainly vertical (compression) loads.

SUMMARY

The embodiments of poles described below have exceptional rigidity. In the embodiments described below, the pole has a metal outer casing with a concrete core. Elongated reinforcing strands are embedded in the concrete near the outer casing. These strands are pre-stressed. Some of the strands may also be encased in sleeves near their upper ends and post-tensioned after the concrete has cured. The pole also may have shear connectors projecting inwardly from the outer casing, extending between the strands, for transferring forces between the concrete core and the outer casing. This configuration yields a pole with increased stiffness and the ability to withstand significant flexural loads.

DETAILED DESCRIPTION

Figure 1:
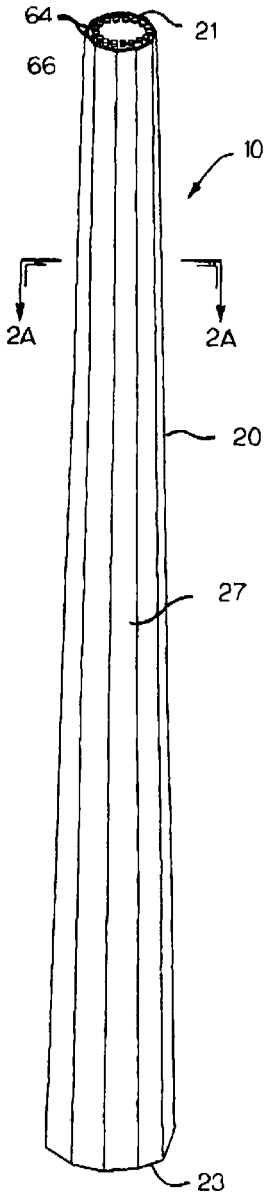
FIG. 1 is a perspective view of one embodiment of a pole made in accordance with the present invention.

FIGS. 1-7 show one embodiment of a pole 10 made in accordance with the present invention. The pole 10 includes an elongated metal outer casing or tube 20 and a concrete core 30. The outer casing 20 defines a top 21, a bottom 23, an inner surface 25, an outer surface 27, and a central vertical axis 29. In this embodiment, the cross-sectional shape of the outer casing 20 is a regular decagon (10-sided polygon), but the cross-sectional shape of the casing 20 could be circular or a number of other polygonal shapes typically used for poles, such as octagonal, dodecagonal or the like. Several reinforcing strands 40 are positioned inside the casing 20 adjacent to its inner surface 25 and extend in the generally vertical direction of the central axis 29.

Figure 2:
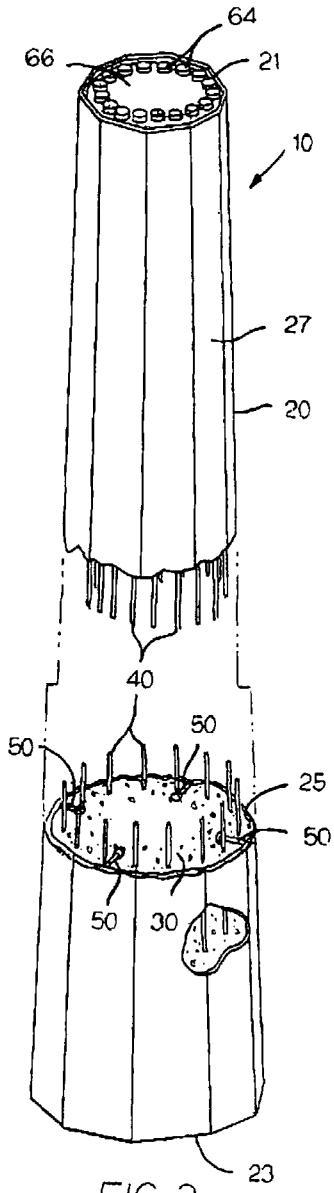
FIG. 2 is a broken away perspective view of the pole of FIG. 1.
Figure 2A:
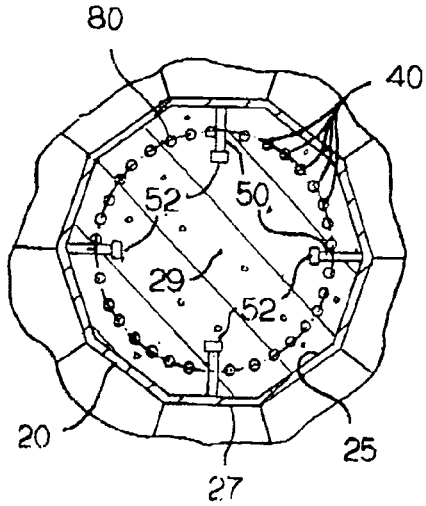
FIG. 2A is a broken away view taken along the line 2A-2A of FIG. 1.

As shown in FIG. 2A, these particular reinforcing strands 40 are evenly spaced apart from each other and are equidistant from the central axis 29, forming an imaginary circular ring 80 around the central axis 29. The ring 80 is denoted by a circle (drawn in phantom in FIG. 2A) which extends through each of the reinforcing strands 40. Of course, in other embodiments, the reinforcing strands may not be evenly spaced apart, or they may not be equidistant from the central axis 29. However, even if the strands are not evenly spaced apart, as long as they are equidistant from the central axis 29 they will form an imaginary ring. Also, even if the reinforcing strands vary slightly in their distance from the central vertical axis, they could be considered to form a ring having a constant radius equal to their average distance from the central axis 29. It would also be possible to have one group of strands that forms a ring and additional strands lying radially outside or inside of that ring.

The reinforcing strands 40 facilitate the pre-stressing of the pole 10 as will be explained in more detail later. In this embodiment, each of the reinforcing strands 40 is partially encased in a post-tensioning sheath 42 (shown in FIGS. 3 and 4) that is used for post-tensioning the pole, as will also be explained in more detail later. The sheaths 42 extend downwardly from the top of the pole 10 to a specified elevation. The elevation at which the sheaths 42 end is preferably lower than 80% of the total height of the pole 10, or, expressed another way, the sheaths 42 preferably extend downwardly a distance that is at least 20% of the distance from the top 21 to the bottom 23. However, that is not required.

Shear transfer connectors 50 are provided at various elevations along the pole 10. These shear transfer connectors 50 are secured to the outer casing 20, as by welding, and project inwardly, toward the central vertical axis 29, with each of the shear transfer connectors 50 extending inwardly between two adjacent reinforcing strands 40.

Concrete is placed inside the outer casing 20, embedding the sheaths 42, the reinforcing strands, and the shear transfer connectors 50.

Figure 4:
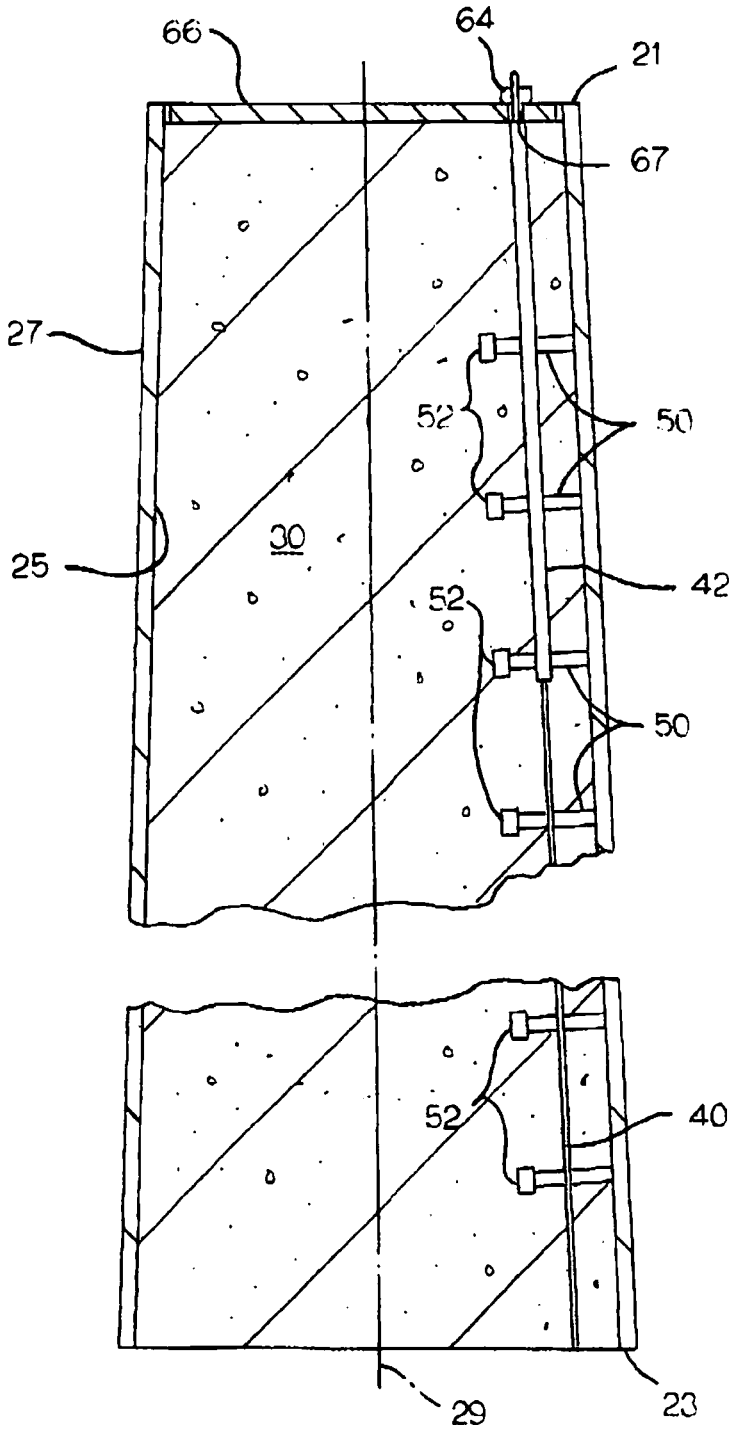
FIG. 4 is a side sectional view of the pole of FIG. 1 in its final form.
Figure 11:
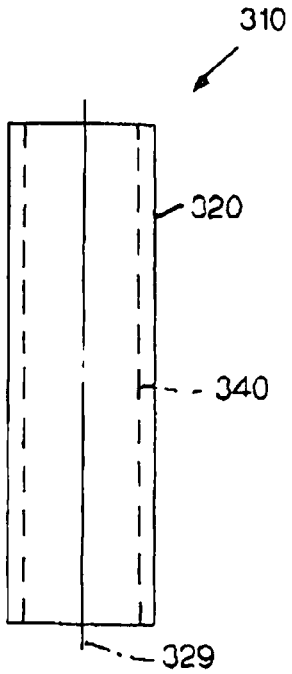
FIG. 11 is a schematic side view of a fourth embodiment of a pole made in accordance with the present invention.

In this embodiment, the pole 10 is tapered such that the outer casing 20 has a smaller diameter at the top 21 and a larger diameter at the bottom 23. As best shown in FIG. 4, in this embodiment, the reinforcing strands 40 lie at a slight angle to the elongated central vertical axis 29, extending parallel to the outer casing 20. However, as shown in an alternative embodiment of FIG. 8, the strands may extend parallel to the vertical axis 29 or, as shown in another alternative embodiment of FIG. 9, the strands may extend at other angles. In addition, the pole 10 may or may not be tapered. FIG. 11 shows an example of a pole that is not tapered.

Figure 3:
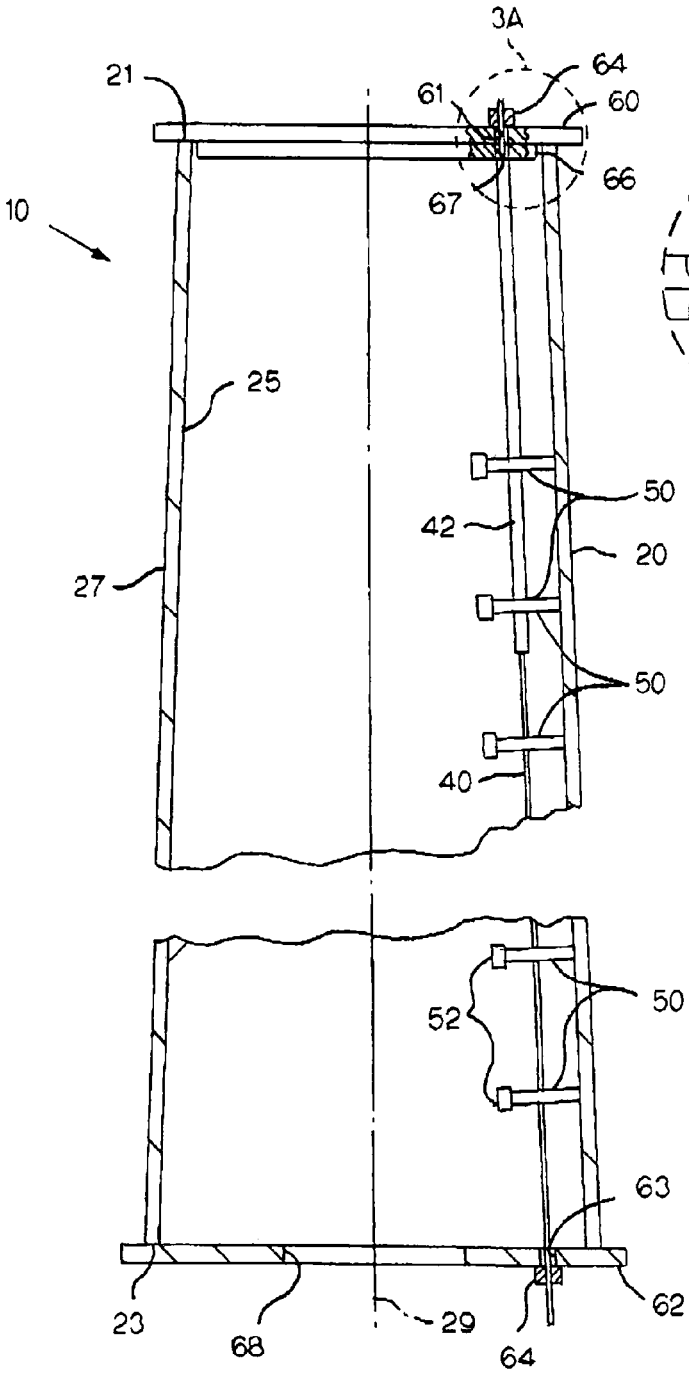
FIG. 3 is a side sectional view of the pole of FIG. 1 in an initial stage of manufacturing.

The shear transfer connectors 50 that project inwardly from the inner surface 25 of the metal outer casing 20 help transfer forces between the concrete core 30 and the metal outer casing 20. As shown in FIGS. 3 and 4, the shear connectors 50 are located at a number of different elevations between the bottom 23 and top 21 of the outer casing 20, and, as shown in FIG. 2A, the shear connectors 50 are situated at different points along the circumference of the inner surface 25 of the outer casing 20. In this embodiment, the connectors are equally spaced from the top 21 of the pole 10 to the bottom 23 of the pole 10 to define a plurality of rows, wherein each row has four connectors 50 that are spaced apart 90 degrees, and each row is aligned with the row directly above and below it. Of course, the quantity and configuration of the connectors may vary depending on the size, shape and application for the pole 10. For instance, the rows of connectors could be spaced closer together or further apart at various positions along the length, there could be more or fewer connectors in each row, the connectors could be in staggered rows, the spacing between the connectors could change for different locations of the pole, and so forth. Regardless of the configuration, the connectors 50 collectively transfer shear forces from the concrete core 30 to the outer casing 20.

In this embodiment, the shear connectors 50 are horizontally-oriented studs, or solid shafts, with heads at their inner ends providing an enlarged diameter at the inner ends of the shear connectors 50. In another embodiment, the shear connectors 50 may be bolts with the enlarged diameter portion provided by a nut threaded onto the bolt. In still other embodiments, the shear connectors 50 may have various other shapes, such as ribs, plates, hooks, arches or the like, as desired, to transfer the forces. They also could be angled upwardly or downwardly.

Figure 10:
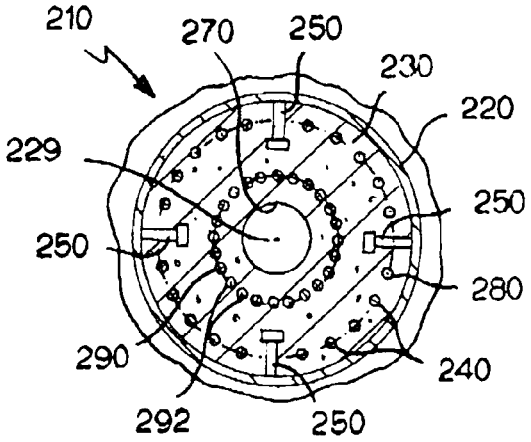
FIG. 10 is a view taken along the line 10-10 of FIG. 9.

FIG. 2A is a sectional view of the pole 10 taken at the same elevation as one ring of shear connectors 50. As shown in FIG. 2A, the shear connectors 50 extend inwardly from the inner surface 25 of the outer casing 20 toward the central axis 29. Each shear connector 50 has an innermost point 52 that is closer to the central axis 29 than are the reinforcing strands 40 in the ring 80 at the same elevation. Positioning the reinforcing strands 40 near the inner surface 25 of the outer casing 20 with the connectors 50 extending inwardly past the reinforcing strands 40 to a point closer to the central axis 29 gives the pole excellent rigidity and bending resistance. As shown in the embodiment of FIG. 10, there may be additional reinforcing strands 292 located closer to the central axis 229. However, in both the embodiments of FIG. 2A and FIG. 10, the shear connectors 50, 250 extend between two adjacent strands 40, 240 projecting inwardly beyond those strands 40, 240.

The manufacturing of the pole 10 is best described with reference to FIGS. 3-6. FIGS. 3, 3A, 5 and 6 are views of the framework of the pole 10 prior to the addition of concrete, and FIG. 4 is a view of the pole 10 in its final form. The basic framework of the pole 10 includes the outer casing 20, the shear connectors 50 extending inwardly from the inner surface 25 of the outer casing, and the plurality of reinforcing strands 40, with sheaths 42 enclosing the upper portions of the strands 40. The outer casing 20 has a top 21 and a bottom 23. A top end plate 60 and a bottom end plate 62 are positioned so as to bear against the top 21 and bottom 23 of the outer casing 20. The end plates 60, 62 are used to pre-tension the strands 40 before filling the pole with concrete. Each of the end plates 60, 62 has a ring of holes 61, 63, respectively, near its outer edge for receiving the strands 40 as best shown in FIGS. 3, 3A, 5 and 6.

Figure 7:
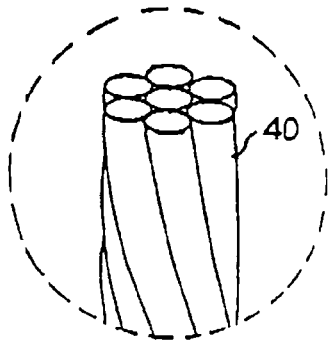
FIG. 7 is an enlarged view of the portion labeled 7 in FIG. 5.

The reinforcing strands 40 extend between the end plates 60, 62 and project outwardly from the holes 61 in the top plate 60 and the holes 63 in the bottom plate 62. Chucks 64 are used to grip the strands 40 and bear against the respective end plates 60, 62, holding the strands in tension between the end plates 60, 62 (with techniques that are commonly known in the art). The reinforcing strands 40 in this embodiment are made of steel, and as best shown in FIG. 7, in this embodiment they are seven-wire twisted strands. Of course, the strands could be made of other suitable materials and could have other configurations. For instance, the strands could be steel single wires, steel bars, fiber reinforced composite bars, or the like. The chucks 64 are designed to anchor the particular strands 40 being used.

In addition to the top and bottom end plates 60, 62, a post-tensioning plate 66 (shown in FIG. 3) is positioned just below the top plate 60 for use in post-tensioning. The post-tensioning plate 66 is a solid disk having an outermost perimeter (or outermost periphery) that fits inside the outer casing 20 just below the top end plate 60. The post-tensioning plate 66 also defines a ring of holes 67 through which the strands 40 extend. Thus, at this stage of manufacture, when the strands 40 are tightened, the top, end plate 60 (and not the post-tensioning plate 66) bears against the outer casing 20. The post-tensioning plate 66 is not secured to the strands 40, the top plate 60, or the outer casing 20, but is located directly below the top end plate 60.

The sheaths 42 are positioned just below the post-tensioning plate 66 and extend downwardly from the post-tensioning plate 66 toward the bottom of the pole. The sheaths 42 preferably are made of plastic tubing or other similar material and have an inside diameter which will allow the free axial movement of the reinforcing strands 40 inside the sheaths 42. The sheaths 42 extend from the top of the pole downwardly to a desired elevation, which preferably is less than 80% of the total elevation of the pole (or 80% of the elevation of the post-tensioning plate 66). This means that the sheaths 42 extend downwardly from the post-tensioning plate 66 a distance that preferably is at least 20% of the distance from the post-tensioning plate 66 to the bottom of the pole 10. The length of the sheaths 42 can vary depending on the particular pole. It is preferred that the sheaths extend to an elevation that is between 60% and 80% of the total height of the pole. In one preferred embodiment, the sheaths 42 extend downwardly approximately 25% of the total length of the pole or to an elevation that is approximately 75% of the total elevation of the pole 10. Of course, in other embodiments some or all of the strands may not be post-tensioned, and the sheaths for those strands could be eliminated, or the sheaths could extend to different lengths.

Figure 3A:
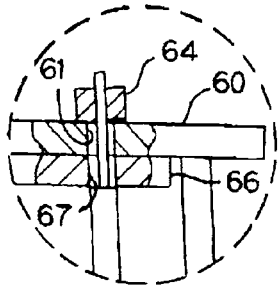
FIG. 3A is an enlarged view of the portion labeled 3A in FIG. 3.
Figure 5:
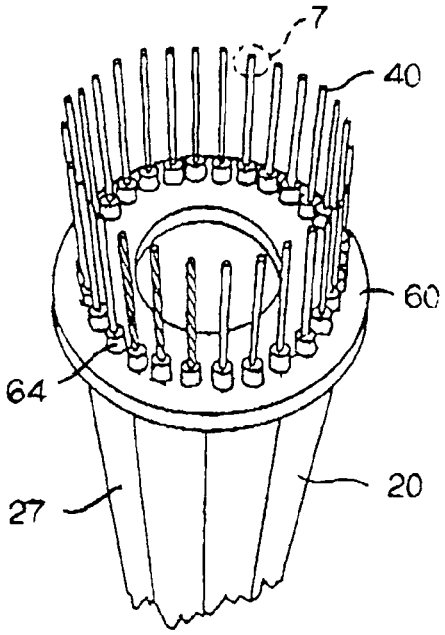
FIG. 5 is a top perspective view of the pole of FIG. 1 in an initial stage of manufacturing.
Figure 6:
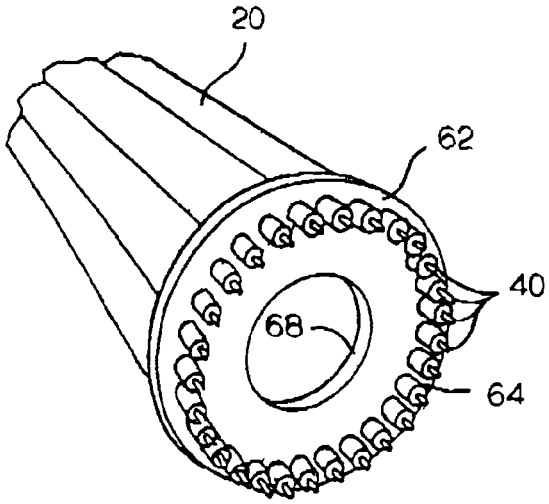
FIG. 6 is a bottom perspective view of the pole of FIG. 1 in an initial stage of manufacturing.

Thus, as best shown in FIGS. 3 and 3A, each reinforcing strand 40 extends through a hole 61 in the top end plate 60, through a hole 67 in the post-tensioning plate 66, through a sheath 42, and through a hole 63 in the bottom end plate 62. Each reinforcing strand 40 is pre-tensioned to a prescribed pre-stressing level by tightening the strands using the chucks 64 on each of the end plates 60, 62 prior to adding the concrete, so that the pole framework is as shown in FIGS. 3, 5, and 6.

The reinforcing strands 40 extend in a straight line path from the top end plate 60 to the bottom end plate 62. As was explained earlier, in this embodiment, the shear transfer connectors 50 are arranged in rows. Each row of connectors 50 lies at a certain elevation along the height of the pole, with two sets of diametrically opposed shear transfer connector studs 50 located on each row (at each elevation). The shear transfer connector studs 50 at each elevation are independent of each other, so that each shear transfer connector 50 at any particular elevation provides a shear force that is independent of the shear force provided by the other shear transfer connectors 50 at that same elevation.

Figure 9:
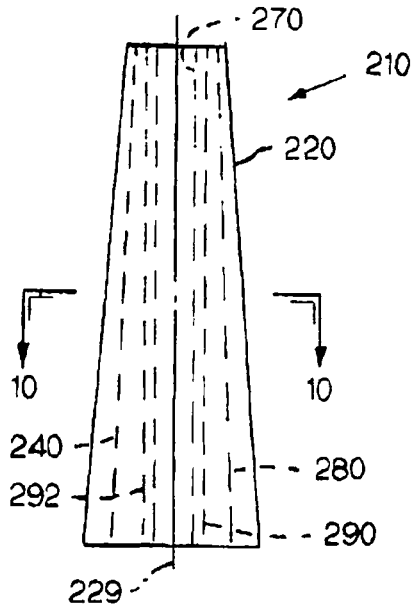
FIG. 9 is a schematic side view of a third embodiment of a pole made in accordance with the present invention.

The next step in the manufacturing of the pole 10 is to substantially fill the interior of the shell 20 with concrete. The bottom end plate 62 has a central opening 68 (shown in FIGS. 3 and 6) which allows the pole 10 to be filled with concrete. After filling the pole 10 with concrete, the concrete is allowed to cure to form a solid concrete core 30. The concrete core 30 extends from the post-tensioning plate 66 to the bottom end plate 62 and embeds the sheaths 42, the reinforcing strands 40, and the shear connectors 50. The outer casing 20 of the pole 10 may be completely filled with concrete, or the pole may be spun cast, yielding a central cavity along the vertical axis of the pole from top to bottom, as shown in FIGS. 9 and 10. The central cavity may be used for housing electrical wires, conduit and the like, if desired.

After the concrete has cured, the chucks 64 are removed, the top and bottom end plates 60, 62 are removed, and then chucks 64 are attached to the encased reinforcing strands 40 above the post-tensioning plate 66 as shown in FIG. 4. (In this embodiment, all the strands 40 are encased, but that is not necessary.) The reinforcing strands 40 are then pulled and anchored against the post tensioning plate 66 using the chucks 64. The bottom portion of each reinforcing strand 40 is embedded in the concrete 30, so pulling on the top ends of the encased strands 40 further tensions the section of the strands 40 encased in the sheaths 42 (post-tensioning the strands 40), causing the post-tensioning plate 66 to press against the top of the concrete core 30, thereby post-tensioning the top portion of the pole 10 and inducing additional compressive stresses on the concrete. Since the post-tensioning plate 66 is not attached to the outer casing 20 and does not press against the outer casing 20, the post-tensioning plate only bears against the cured concrete core 30 and not the outer casing 20, putting the concrete 30 in compression. Of course, the lower portion of each strand 40, which is embedded in the concrete, also puts the concrete in compression. At the same time, the shear connectors 50 help transfer compressive forces between the concrete core 30 and the outer casing 20, both in the lower portion of the pole, below the sheaths 42, and in the post-tensioned upper portion. As a final step in the manufacturing of the pole, the reinforcing strands 40 are cut at the top and bottom of the pole to place the pole in its final form, as shown in FIGS. 1, 2, and 4.

The post-tensioning plate 66 is located at the top of the pole 10, and in this embodiment, the plate 66 fits inside the outer casing 20 just below the top end plate 60 in order to bear against the top of the concrete core 30.

Figure 8:
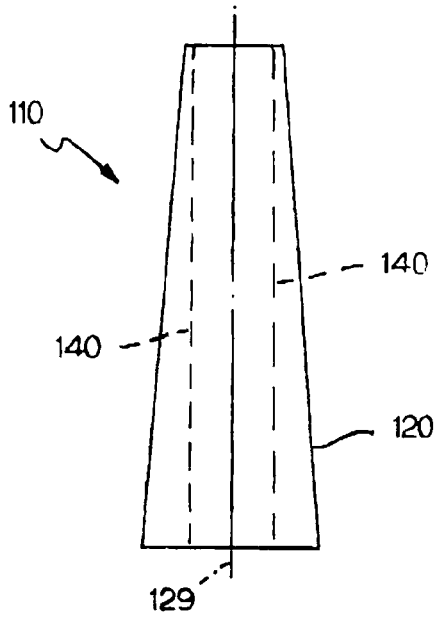
FIG. 8 is a schematic side view of a second embodiment of a pole made in accordance with the present invention.

FIG. 8 is a schematic view of a second embodiment of a pole 110 made in accordance with the present invention. This embodiment is generally the same as the previous embodiment except that the reinforcing strands 140 extend parallel to the central vertical axis 129 instead of parallel to the outer casing 120.

FIGS. 9 and 10 are views of yet another embodiment of a pole 210 made in accordance with the present invention. The pole 210 includes a tapered outer casing 220 having a circular cross-section and defining an elongated central vertical axis 229 and a concrete core 230. The pole 210 has been spun cast, yielding a central cavity 270 in the center of the concrete core 230 extending along the entire length of the pole. The pole 210 has outer reinforcing strands 240 defining an imaginary outer ring 280 and inner strands 292 defining an imaginary inner ring 290. The outer ring 280 and inner ring 290 are designated with phantom lines in FIG. 10. As best shown in FIG. 9, each of the outer reinforcing strands 240 lies at an angle relative to the central vertical axis 229, but that angle is not the same as the angle of the casing 220. The inner reinforcing strands 292 are vertical, lying parallel to the central axis 229. Shear transfer connectors 250 are positioned at various elevations of the pole 210. At least in the upper portions of the pole, the shear transfer connectors 250 extend inwardly between adjacent outer reinforcing strands 240 to a point that is within the outer ring 280, but they do not extend inwardly as far as the inner strands 292. The inner strands 292 may be pre-tensioned, post-tensioned, or both.

FIG. 11 is a view of still another embodiment of a pole 310 made in accordance with the present invention. In this embodiment, the pole is cylindrical and is not tapered, and the reinforcing strands 340 extend vertically, parallel both to the outer casing 320 and to the central vertical axis 329. In this embodiment, the shear connectors (not shown) extend inwardly beyond the strands 340.

It will be obvious to those skilled in the art that modifications may be made to the embodiments described above without departing from the scope of the invention as claimed.

What is claimed is:

1. A pole, comprising:

an elongated metal outer casing defining a top, a bottom, an inner surface, an outer surface, and an elongated central vertical axis;

a plurality of reinforcing strands located inside and adjacent to said outer casing and extending in the general direction of said elongated central vertical axis;

a plurality of shear transfer connectors arranged at various elevations along said metal outer casing, each shear transfer connector projecting inwardly from said inner surface of said metal outer casing and at least some of said shear transfer connectors extending inwardly between two respective reinforcing strands;

wherein said shear transfer connectors are elongated studs having first and second ends, with the first end secured to said outer casing and with an enlarged diameter at the second end; and a concrete core substantially filling said elongated metal outer casing from top to bottom, wherein said shear transfer connectors and said reinforcing strands are embedded in said concrete core; and including means for transferring shear forces between the metal outer casing and the concrete core through said shear transfer connectors;

wherein said concrete core has a top, and further comprising:

a post-tensioning plate adjacent the top of said concrete core, wherein said reinforcing strands extend through openings in said post-tensioning plate; and including means for at least some of said reinforcing strands to apply a force to the post-tensioning plate that causes the post-tensioning plate to apply a compressive force to the concrete core while not applying a compressive force to the metal outer casing.

2. A pole as recited in claim 1, and further comprising:

a plurality of sheaths encasing at least some of said reinforcing strands and extending downwardly from said post-tensioning plate to an elevation that is less than 80% of the elevation of said post-tensioning plate, wherein said encased reinforcing strands are tensioned against said post-tensioning plate, causing said post-tensioning plate to apply force against the top of said concrete core.

3. A pole as recited in claim 2, wherein said outer casing is tapered from a smaller diameter at the top to a larger diameter at the bottom.

4. A pole as recited in claim 3, wherein at least some of said strands extend parallel to said elongated central vertical axis.

5. A concrete filled pole as recited in claim 3, wherein at least some of said strands extend at an angle to said elongated central vertical axis.

6. A concrete filled pole as recited in claim 5, wherein said strands extend parallel to said tapered outer casing.

7. A concrete filled pole as recited in claim 1, wherein at least some of said reinforcing strands include a plurality of twisted wires.

8. A pole as recited in claim 1, and further comprising a plurality of sheaths encasing at least some of said strands and extending downwardly from said top;

wherein said sheaths are embedded in said concrete core.

9. A pole as recited in claim 8, wherein said sheaths extend downwardly to an elevation that is less than 80% of the elevation of the post-tensioning plate.

10. A concrete filled pole as recited in claim 9, wherein said sheaths extend downwardly to an elevation that is between 60% and 80% of the elevation of the post-tensioning plate.

11. A pole as recited in claim 1, wherein said plurality of reinforcing strands located inside said outer casing and extending in the general direction of said elongated central vertical axis are approximately equidistant from said elongated central vertical axis and define an imaginary outer ring.

12. A concrete filled pole as recited in claim 11, and further comprising at least one inner strand, wherein said at least one inner strand extends in the general direction of said elongated central vertical axis and lies inside said outer ring.

13. A pole as recited in claim 1, and further comprising:

top and bottom end plates;

wherein said reinforcing strands extend in a straight line path from said top end plate to said bottom end plate.

14. A pole as recited in claim 13, wherein said shear transfer connectors are independent of each other, including means for each shear transfer connector at a given elevation to be functionally interconnected with the other shear transfer connectors at that given elevation only by the metal outer casing and the concrete core.

15. A pole as recited in claim 14, wherein the shear transfer connectors are arranged such that there is at least one pair of diametrically opposed shear transfer connectors at one elevation.

16. A pole as recited in claim 15, wherein there are at least two pairs of diametrically opposed shear transfer connectors at one elevation, with one of said pairs lying at a position that is ninety degrees offset from the other of said pairs.

17. A pole as recited in claim 13, wherein said concrete core has a top, and further comprising:

a post-tensioning plate adjacent the top of said concrete core; wherein said reinforcing strands extend through openings in said post-tensioning plate; and further comprising a plurality of sheaths encasing at least some of said reinforcing strands and extending downwardly from said post-tensioning plate; and including means for at least some of said reinforcing strands to apply a force to the post-tensioning plate so as to cause the post-tensioning plate to apply a compressive force to the concrete core while not applying a compressive force to the metal outer casing.

* * * * *